United States Patent [19]

Bingham

[11] 4,069,832

[45] Jan. 24, 1978

[54] COLLAPSIBLE ROD AND JOINT STRUCTURE FORMING A TETRAHEDRAL OR SIMILAR FRAME

[76] Inventor: Andrew M. Bingham, 12 Walnut St., W. Hempstead, N.Y. 11552

[21] Appl. No.: 715,381

[22] Filed: Aug. 18, 1976

[51] Int. Cl.[2] ..... A45F 1/16

[52] U.S. Cl. ..... 135/3 R; 52/648; 52/DIG. 10; 135/15 PQ; 403/172

[58] Field of Search ..... 52/648, DIG. 10, 63; 403/176, 171, 172, 217, 218, 219, 4, 3; 46/29; 135/3 R, 15 PQ

[56] References Cited

U.S. PATENT DOCUMENTS

| | | | |
|---|---|---|---|
| 690,102 | 12/1901 | Dummer | 135/3 R |
| 1,081,902 | 12/1913 | Fowzer | 135/3 R |
| 1,092,217 | 4/1914 | Hopkins | 403/172 |
| 2,810,390 | 10/1957 | Wallace | 135/3 R |
| 2,982,379 | 5/1961 | Fisher | 403/171 |
| 3,521,421 | 7/1970 | Schroeder | 52/648 |
| 3,927,489 | 12/1975 | Bernstein | 46/29 |

FOREIGN PATENT DOCUMENTS

| | | | |
|---|---|---|---|
| 544,287 | 7/1956 | Belgium | 135/3 R |

*Primary Examiner*—Price C. Faw, Jr.
*Assistant Examiner*—Henry Raduazo

[57] ABSTRACT

A collapsible rod and joint structure forming a polyhedron frame comprising sleeve or sleeve-type open sleeve joints cooperating with corner connection joints at the ends of each arm of the structure. The folding of a polyhedron is accomplished when all of the horizontal base arms joining the vertical arms radiating from the apex joints are each folded on hinged corner joints at the base of each vertical arm to connect to, after disengaging from the corner connection joint on the adjacent vertical arm, are folded so that the arms rest in parallel and together, whereby all dual sets are folded toward each other so that all arms rest in parallel and together.

7 Claims, 22 Drawing Figures

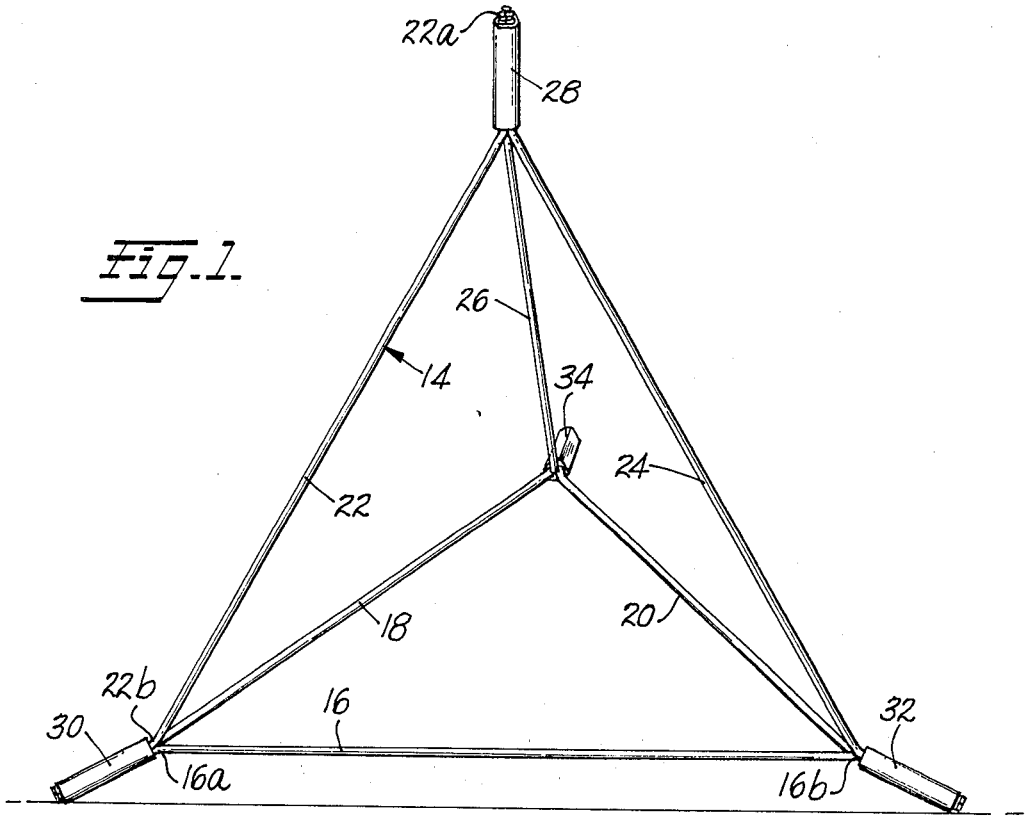
Fig. 1.
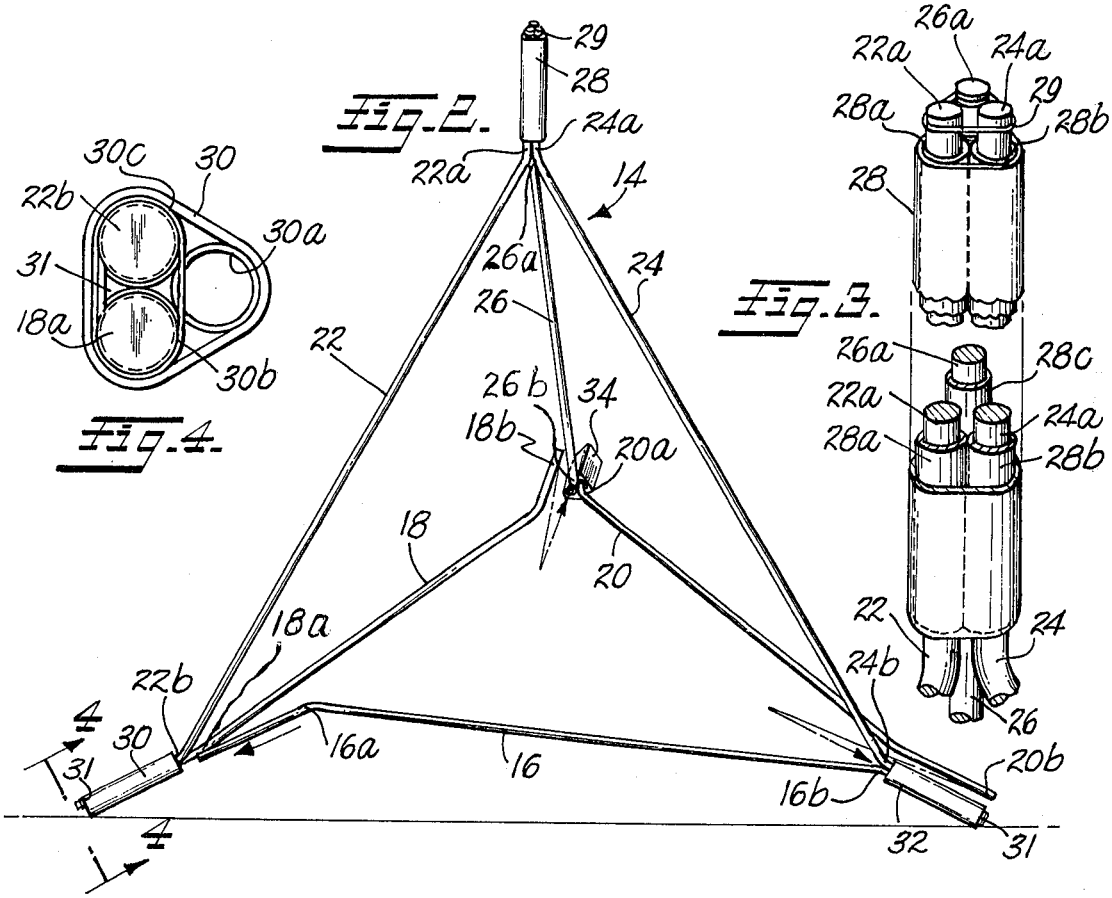
Fig. 2.
Fig. 3.
Fig. 4.

Fig. 10.
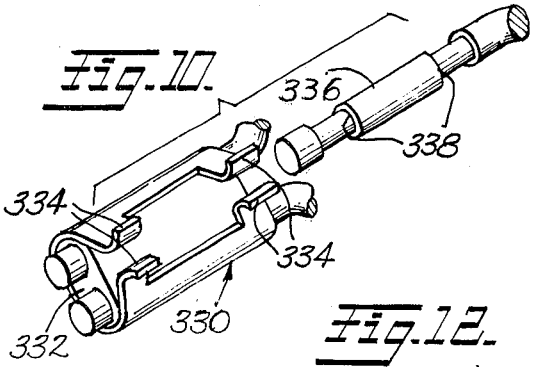
Fig. 11.
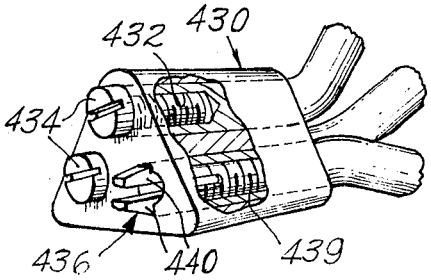
Fig. 12.
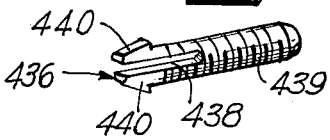
Fig. 13.
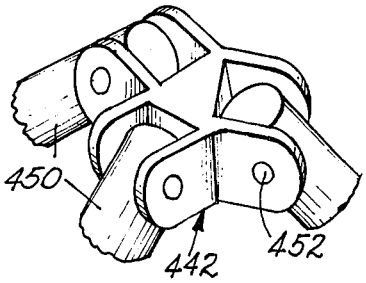
Fig. 14.
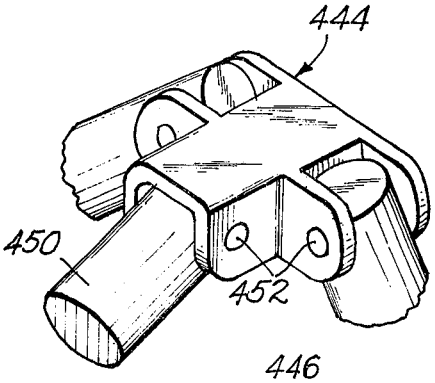
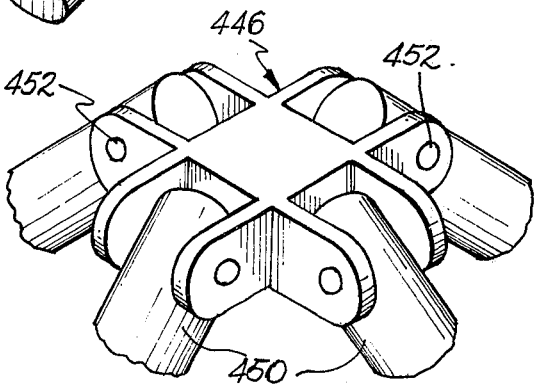
Fig. 15.
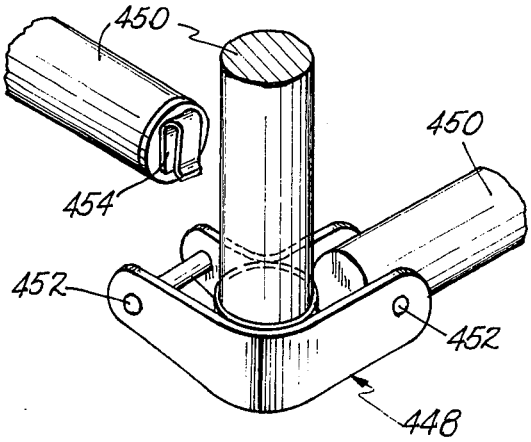
Fig. 16.

COLLAPSIBLE ROD AND JOINT STRUCTURE FORMING A TETRAHEDRAL OR SIMILAR FRAME

BACKGROUND OF THE INVENTION

1. Field of the Invention

The invention lies within the field of static structures of polyhedron form and in the field of joints and connections having articulated members in which there are plural distinct articulation axes and a plurality of translating connections in which the articulated members are lockable at fixed positions. It is a distinct characteristic of the structures in this field of the invention that three or more radiating members are presented in a regular polyhedral connection and that at least two of the arms of the tetrahedron be disengageable from a sleeve joint to fold and collapse in the form of a bundle.

2. Description of the Prior Art a. Rigid Structures

In the prior art of polyhedral structures, the patent to Alexander Graham Bell, U.S. Pat. No. 770,626, granted Sept. 20, 1904, describes a rigid polyhedral frame structure useful as an aerial vehicle or kite and formed of equal bars united at the corners. In the various figures of the Bell drawings, there are shown single tetrahedral elements, double tetrahedral elements constituting wings in a pair, four winged tetrahedral wing structures, and the like. Also described in this Bell patent are connecting corner pieces which serve as coupling blocks to join the ends of the bars in making compound tetrahedral structures for forming wings consisting of tetrahedral cells.

A comparable rigid tetrahedron shaped structure is shown in the patent to Paul Snibbe, U. S. Pat. No. 3,468,503, which is proposed as a kite with high efficiency lift properties.

In contrast to these closest prior art rigid structures, the present invention is directed to collapsible rod and joint structures and to novel and unique folding methods for erecting and collapsing a tetrahedron structure which is adapted to serve in a new way for games, such as for example, the game of soccer, water pole, basketball, and the like.

b. Folding Structures

James R. Brown, U.S. Pat. No. 2,555,220, discloses a tent frame construction of polyhedron-shape which folds into a compact form. This structure is in common use in photographic tripods, painting easels, etc., and not rigid and has no base connecting arms joining the vertical arm.

c. Joint Structures

Clinton Starbard, U.S. Pat. No. 932,344, discloses joints which are rigid, and therefore permit no folding.

Jack F. Smith, U.S. Pat. No. 2,180,125, discloses the tri-joint which permits no rotation of arms as a hinge.

William Herschaft, U.S. Pat. No. 2,765,580, shows tri-joints which are rigid and thereby does not permit folding of the arms.

Charles Attwood, U.S. Pat. No. 3,270,478, discloses tri-joints which are rigid and permit no folding of the arms.

George L. Kilgore et al, U.S. Pat. No. 2,290,437, discloses a sleeve, but it is not designed to allow arms to rotate in joint-like method.

Arthur E. Fentiman, U.S. Pat. No. 2,976,968, discloses joints, again rigid, and permit no folding of the arms.

d. Distinctions over the Prior Art

In respect to the prior art patents mentioned above, none of the patents, which have been found by the applicant as a result of his study and research of the prior art, show the unique method of folding a collapsible polyhedron, which requires that the vertical arms radiating from the apex pivot and connect to sleeve corner joints at the base of each vertical arm whereby the arms are disengaged at the base joints and collapse in folded condition, these base arms comprising dual sets of arms each folded toward the other with the arms resting in parallel relation and together after being folded.

In certain groups of patents such as Starbard and Bell, rigid joints are employed, and no sleeve structure is contemplated. In other groups of patents, such as Kilgore et al, sleeves are disclosed, but the rod members, which are secured in the sleeve, cannot pivot or rotate and thereafter disengage and fold.

SUMMARY OF THE INVENTION

A collapsible rod and joint structure forming a polyhedron comprising sleeve joints cooperating with corner connection joints at one end of the structure, each of the arms of the polyhedron joining at least two other arms at a common sleeve at a corner of the polyhedron and each arm being foldable in relation to one adjacent arm so as to lie in parallel relation to said arm in the folded condition, the end of the rod, which is detached from the sleeve to fold in such parallel relation, being adapted to be inserted into said sleeve so that pairs of arms folded with each pair in parallel relation can be pivotally moved at the corner joints to erect said polyhedron with the unfolded arms in firmly locked relation in said sleeve joints.

In one form of the invention, the polyhedron is an equilateral tetrahedron uniquely adapted for such ground level or water level games, such as soccer, water polo, ground level basketball, field hockey, etc. The relatively light tetrahedron rests on the ground and the ball enters the opening defined by any three sides to trap the ball and possibly turn over under the force of impact at the rear.

In another form of the invention, the polyhedron may be a tetrahedron having a square base and in this form the structure serves as a toy house, tent part, playhouse frame, roadside sign frame, or a building component.

In still another form of the invention, the polyhedron is in the form of a five sided tent frame having a rectangular base and a roof chord parallel to and displaced from the base, the roof chord being supported by equal side rods defining the front and rear of the tent structure. In this form, the polyhedron of the invention is suitable for a very large number of uses, such as a soccer goal, lacrosse goal, team handball goal, hockey goal, field hockey goal, other goals, tent frame, child's playhouse frame, puzzle, road signal frame, building component, swing set, bicycle rack, horizontal bar, "pitch-back", tennis ball bounce-back, playground "climber" frame, football blocker frame, support element, pet toy, pet house frame, baseball, softball, kickball, backstop, etc.

OBJECTS OF THE INVENTION

An object of the invention is to provide polyhedron frame structure comprising sleeve joints cooperating with corner connection joints.

Another object of the invention is to provide a novel combination of sleeve joints cooperating with corner connection joints at the ends of arms, each of the arms of the polyhedron joining at least two other arms at a common sleeve at a corner of the polyhedron and each arm being foldable in relation to one adjacent arm so as to lie in parallel relation to said arm in the folded condition, the end of the rod which is detached from the sleeve to fold in such parallel relation being adapted to be inserted into said sleeve so that pairs of arms folded with each pair in parallel relation can be pivotally moved at the corner joints to erect said polyhedron with the unfolded arms in firmly locked relation in said sleeve joints.

A still further object of the invention is to provide new structure to serve as goals for ground level games comprising a collapsible polyhedron made up of sleeve joints cooperating with corner connection joints.

A still further object of the invention is to provide structural supporting devices useful for tent frames, playhouses, roadside signs, and the like formed of a collapsible rod and joint structure forming a polyhedron comprising sleeve joints cooperating with corner connection joints at one end of the structure.

BRIEF DESCRIPTION OF THE DRAWINGS

FIG. 1 is a perspective view of a collapsible frame of the present invention;

FIG. 2 is a perspective view of the frame of FIG. 1 showing the frame in a partially erected position;

FIG. 3 is an enlarged fragmentary perspective view of the top frame anchor;

FIG. 4 is an enlarged end view of one of the ground engaging anchors, taken on the line 4—4 of FIG. 3;

FIG. 10 is a fragmentary perspective view showing a modification of a frame rod end connector;

FIG. 11 is a further modification of a frame rod end connector illustrating the end of the free rod assembled to the connector by a flexible latch;

FIG. 12 is a perspective view of the flexible latching member; and

FIGS. 13 through 17 are enlarged fragmentary perspective views of various pivotal rod joints used for assembling a support frame.

DESCRIPTION OF THE PREFERRED EMBODIMENTS

Figures 5, 6, 7, 8, 9:
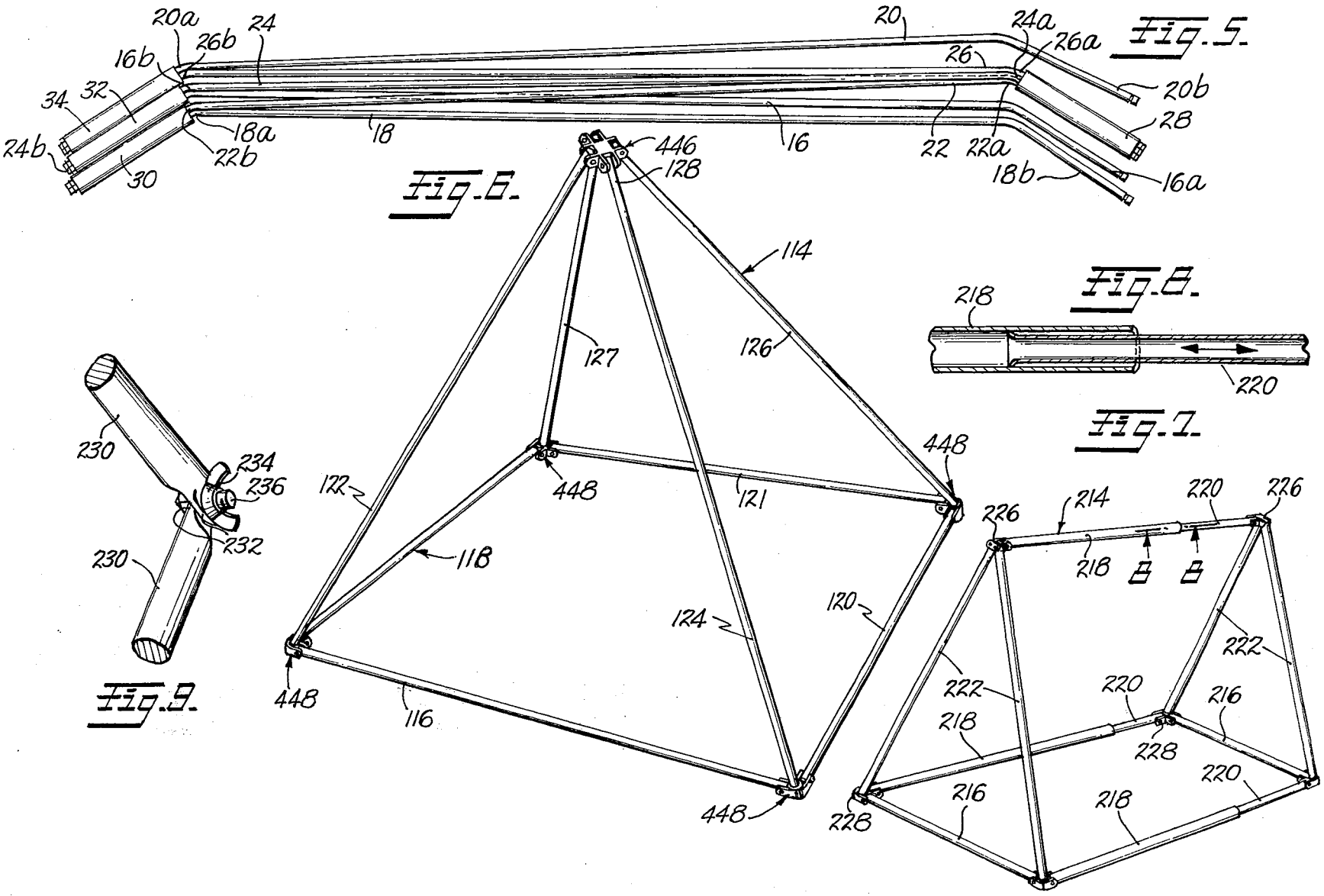
FIG. 5 is a view, on a larger scale, showing a frame in its collapsed position.
FIG. 6 is a perspective of a modification of the frame having a four sided base and the frame supports having their ends provided with a return bend so that the ground engaging anchors project within the outline of the tent.
FIG. 7 is perspective of an extensible tent frame.
FIG. 8 is an enlarged fragmentary sectional view through one of the frame fittings, taken on the line 8—8 of FIG. 7.
FIG. 9 is a fragmentary perspective view of frame connection showing the supports thereof in an angular position.

The collapsible frame 14 illustrated in FIG. 1 is in the shape of a tetrahedron, with the rods serving as the frame elements 16, 18, 20, 22, 24 and 26. The associates sleeve elements and the four corners of the tetrahedron are frame socket 30 which serves as the sleeve for frame elements 16, 18 and 22. Frame socket 32 serves as the sleeve for frame elements 16, 20 and 24. Frame socket 34 serves as the sleeve for frame elements 18, 20 and 26. Frame socket 28 serves as the sleeve for frame elements 22, 26 and 24.

It is an essential feature of the regular tetrahedron shown in FIG. 1, that two of the frame elements for frame sockets 30, 32, 34 be fixed in the socket and the third be foldable in relation to the adjacent arm when in the folded condition, which is illustrated in FIG. 5.

The fixing of two of the frame elements within the frame socket is accomplished by means of a locking wire; the frame elements in the regular tetrahedron are all equal in length and are each formed with an arm at the end which is shown bent in the downward direction in the collapsed view of FIG. 5.

Accordingly and as shown in FIG. 4, the locking of arm **18*a* of frame element 18 within the inner sleeve 30*b* of frame socket 30 is accomplished by means of locking wire 31. The locking of arm 22*b* of frame element 22 within inner sleeve 30*c* is accomplished by this same means, e.g., by the locking wire 31, so that both arms 18*a* and 22*b* are locked by means of the same locking wire 31. Arm 16*a*, the arm for socket sleeve 30*a*, can be easily inserted into the sleeve or withdrawn (see FIGS. 2 and 4**).

The locking arm **20*b*, which is rotatable freely as shown in FIG. 2, positions arm 20*b* within frame socket 34. This positioning is accomplished by pushing the free end of arm 20*b* in the direction shown by the arrow at the lower right corner of the tetrahedron as illustrated in FIG. 2. The two front corners of FIG. 2** are now in the locked position.

The locking of arm **18*b*, which is the free end of frame element 18, requires rotation of element 18 to position arm 18*b* in order to align the arm 18*b* with the free inner socket of frame socket 34. This free inner socket is shown in FIG. 2 behind the arrow, and the manipulation of arm 18*b* follows substantially the path of the dotted line behind the arrow. This locks the rear corner of the tetrahedron 14 in FIG. 2**.

Thus, the manipulation of the free arm **20*b* of frame element 20 into right front frame socket 32, that of free arm 16*a* into left front frame socket 30, that of free arm 18*b* into rear frame socket 34, fixes and erects the base of the tetrahedron 14**.

The apex frame socket 28 differs from each of the base frame sockets 30, 32 and 34 in that all of the inserted arms are locked, e.g., all three arms by means of three arm apex sleeve joints as shown in FIG. 3. Locking wire 29 serves to lock all three arms **22*a*, 24*a* and 26*a* at the very tip of these arms as shown in FIG. 2 and FIG. 3. The inner sleeve construction shown in fragmentary view at the bottom of FIG. 3 provides a separate inner sleeve 28*a* of the frame socket 28 for secure engagement of of a substantial part of the length of arm 22, and similarly inner sleeve 28*b* engages with the length of arm 24*a* and inner sleeve 28*c* engages with the length of arm 26*a***.

If the right front corner, left front corner and rear corners are to be dismantled, all that is necessary is to reverse the movement above explained for assembly, e.g. arm 16*a* is pulled out of frame socket 30, arm 20*b* is pulled out of frame socket 31 and arm 18*b* is pulled out of frame socket 34. By rotating frame elements 18 and 22 together, 16 and 24 together and 20 and 26 together, we have the collapsed condition shown in FIG. 5.

In FIGS. 6 – 9 and 15, there are shown views of tent or similar structure frames of rod and sleeve construction under which the rod-like frame elements of the invention may take the shape of tubular or similar structure forms, as for example, frame element 218 or of rod form 450, see FIG. 15. As shown in FIG. 8, tube elements 218 and 220 may be in telescoping engagement with frame element 226 and is useful in setting up a tent or similar construction in accordance with the invention. Tent frame 114 in FIG. 6 is pyramid or rectangular tetrahedron with one apex. Tent frame 214 has a double apex.

The four frame elements for the tetrahedron frame in FIG. 6 are shown in a single connection with single open sleeve apex 446. This apex sleeve 446 shown in greater detail in FIG. 15 is formed of a cruciform body portion with pins 452 between the open sleeve portions defined by the parallel walls in each of the four quadrants. Pins 452 engage into holes in the arm ends of the rods 450 of FIG. 15.

In the specific tent embodiment of FIG. 6, the structural frame elements 116, 118, 120 and 121 form the rectangular base. Frame elements 122, 124, 126 and 127 form the sides and are joined at the top arm portions by the open sleeve apex 446.

Although one form of apex joint 446 is shown in FIG. 6 for the interengagement at the top end of each of the plurality of rod elements or rod elements formed of telescoping tubes as in FIG. 8, it is obvious that the plurality of elements of rod type elements so joined may be greater in number than 4, e.g., for example, five elements as shown by the attachment of rod type members 450 through pins 452 in the modified open sleeve joint connector 446 as shown in FIG. 15. Or as shown in FIG. 14, only three rod elements 450 are joined by pins 452 in the apex open sleeve connector 444. Contrast this shape of connector 444 with one covered top part of the clip or type of corner connector in FIG. 16 which is so easily adapted for the base corners and as shown in FIG. 6.

In the tent-like arrangement of FIG. 7, the tent frame 214 is formed of the frame elements 216, 218, 220 and 222. The sleeve element 220 shown in cross section along section line 8—8 in FIG. 8 is formed of telescoping tube portions 218 and 220. The frame elements are thus rod like in their regidity but each is formed of tubular members capable of being collapsed into minimum space without any sacrifice in rigidity.

The corner joint 228 of the rectangular base part of tent-like frame 214 in FIG. 7 is shown in detail in FIG. 16. This joint 228 has the advantage of easy assembly and disassembly based upon coaction of clip elements 454 with the pin 452 in the open sleeve right angle body of corner joint 448. The two rod ends of the base and the end of the vertical rod each with its clip element 454 to engage a pin permits an easy X, Y, Z co-ordinate type of assembly by simple clip on action as shown in FIG. 16. In instances where the strength requirement is not too rigid, this type of joint is advantageous.

In FIG. 9, wing nut means is shown for providing a two plane change in a frame part of a polyhedron made in accordance with the invention wing nut 234 on both 236 which is disposed in the bore or opening of flattened rod ends 232 at the rod 231.

The identification of a corner joint as compared with an apex joint is based upon the factors of (1) permanency of joint, (2) complexity, (3) joint location, and (4) the unique coaction of the ends of the rod-like member with one of them being capable of withdrawal for knockdown and assembly.

Obviously, the distal projection of the rod from the joint creates the direction and configuration of the frame elements of the polyhedron and the bending of the rod elements near the joint is of importance (see FIGS. 21 and 22) in locating the connector in relation to a corner or apex of the structure.

In FIG. 1, bent arm end 16*b* is fixed into one type of corner joint and is one of the two arm ends fixed in a single corner joint. All three corner joints of the assembled frame 14 are identified, while only one end of the frame member is withdrawable and the end opposite to 16*b*, e.g., end 16*a* is withdrawable. The situation is similar in respect to end 20*a* in FIG. 2 in a connector of triangular cross section.

However, in the instance of ends 24*b* and 26*b* of the rod 24, in FIG. 2, both ends are fixed longitudinally and this fixed relationship defines and creates the vertical relationship, e.g., one end joint is a part of the base and the other constitutes the single vertex or apex. The apex joints are formed at the ends 22*a*, 24*a*, and 26*a* in FIG. 2. In this connection, see the relationship of these ends in FIG. 5, in collapsed condition to see the relationship to the method of folding.

The apex joint and corner joint are more clearly distinguished in polyhedra having more than one type of geometric surface, e.g., triangles and a rectangle, triangles and a square, etc., and this is shown in FIG. 6. The apex joint 446 in FIG. 6 provides a permanent modified open sleeve joint (see FIG. 15 for details) wherein 4 rod-like ends are fixed for pivotal movement only (no rotation). Obviously, this four rod type of joint is in a general class of fixed apex joint as exemplified by the four rod joints in FIG. 20 of different construction.

Obviously, locating an apex joint in the base instead of at the top does not change the joint, but these variations illustrate the spirit and scope of the apex joint formed by fixed rod ends and one removable rod end. The outer shape of the body portion of the apex joint may be changed, while the sleeve portions remain the same, but the rod ends may be bent in different fashions to change the structure. The rod ends may be bent in any manner as long as the distal portions of the rod form the required straight line parts of the frame to create the intended polyhedron.

Figure 21:
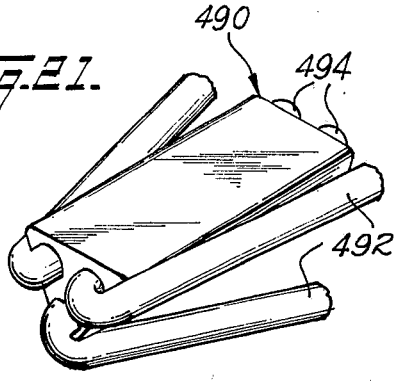
Figure 22:
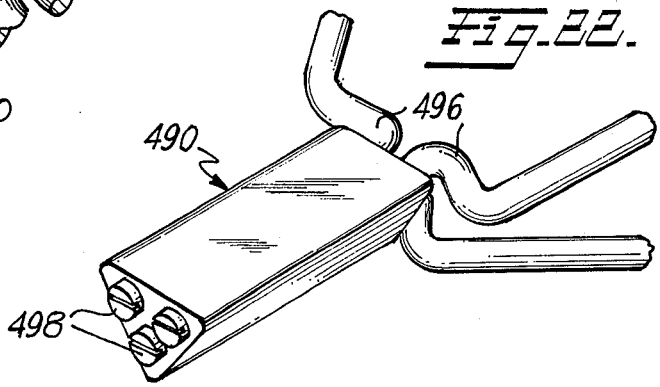

Although the illustrations in FIGS. 21 and 22 are those of three rod apex joints, lying on the base, the particular bending of the rod ends can work equally as well with three rod apex joints, apex joints of more than three rods, and also corner joints. This bending of the apex and corner joints would usually work in unison.

Figure 17:
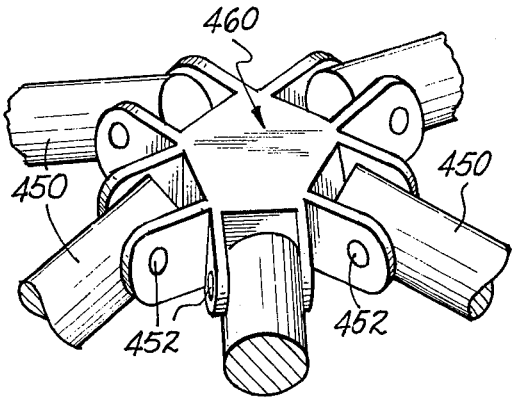

A six rod apex joint of similar construction to FIG. 17 can also be used as well as a seven rod, eight rod, etc., and this progression will also work with the other type of apex joint, FIGS. 1, 2, 3, 4, 5, 18, 19, 20, 21 and 22. The corner joint corresponding in construction with the apex joint will generally be used (example — FIG. 1 apex with FIG. 11 corner, and a FIG. 15 apex with a FIG. 16 corner).

Figure 18:
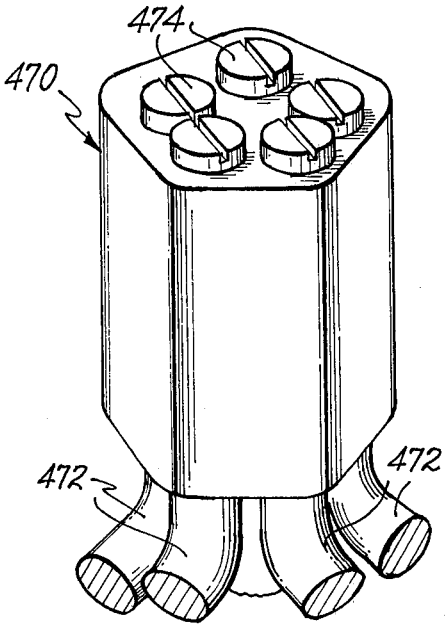
FIGS. 18 through 20 are fragmentary perspective views of different forms of apex joints; and, FIGS. 21 and 22 are fragmentary perspective views of further modifications of the frame anchor.
Figure 19:
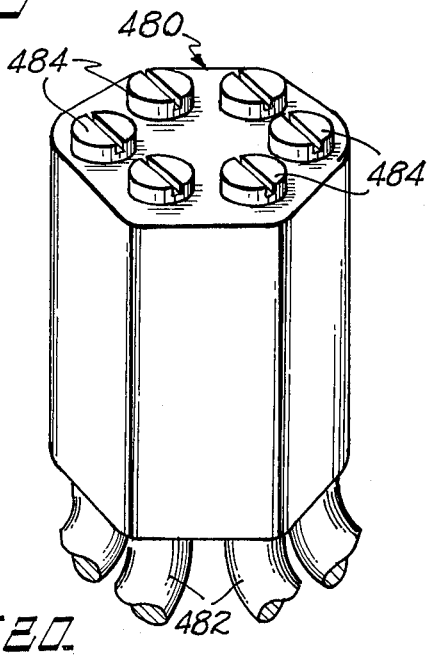
Figure 20:
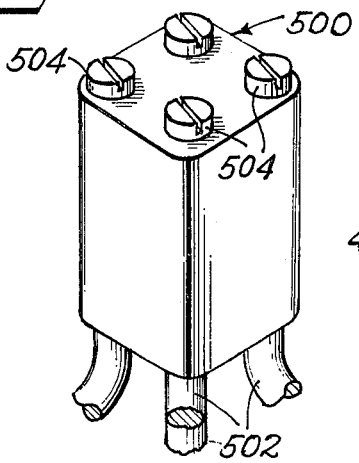

Also as illustrated in FIGS. 21 and 22, the apex sleeve joint of FIGS. 1, 2 and 3 can also be constructed as a one piece solid similar to that in FIGS. 18, 19 and 20.

In FIGS. 10 and 11 are shown totally enclosed corner joints 330 and 430, which are significantly different in both structure and function than the totally enclosed apex joints 470, 480 and 500 of FIGS. 18, 19 and 20.

The main difference lies in the coaction of the interfitting rod-like member and the totally enclosed body portion of the joint, especially the fixed or removable function for the rod end in the sleeve of the joint, only one of the three rod ends being removable from the sleeve which is assigned to said end.

Thus, in FIG. 10, rod 336, which is shown inwardly bent for sleeve alignment and easy disengagement after assembly, is insertable and detachable from its sleeve part of the three-sleeve body of the joint 330, while the other two rod ends are fixed in longitudinal direction by appropriate retaining means. In FIG. 10, the retaining means constitutes the enlarged end or head of the rod, which protrudes past the edge of the body portion of joint 330 and the clip or spring action provided by the open clip structure designated by reference numerals 334. The clip co-acts with the grooves behind the enlarged head portions at each rod end to permit a simple insertion and a locking action which securely retains the two ends of the permanently inserted rods located at the bottom left end of FIG. 10 during the manufacture of this joint. Although FIG. 10 shows two grooves, only one may be used if desired. These two fixed rods are generally easily rotated for engagement to other joints at the distal ends, and the adjustable other rod end is inserted as the last assembly step. There are frequent instances where one of the fixed rods may be constrained against rotation in order to facilitate assembly and knockdown; for example, the fixed rods may be so twisted if both rotate as to require excessive experimentation in assembling complex many sided polyhedra. To accomplish such constraint, the inner sleeve portion of the clip may be provided with a pinched stop portion or a strong adhesive may be used or a pin may be inserted, etc.

In those cases where a low cost very stable joint is required, the construction of FIG. 11 may be preferred over the clip type apex joint of FIG. 10. The advantage of the clip spring action of the FIG. 10 construction is to make up or compensate for lack of flexibility of the frame as made up by the rod-like members.

The unique characteristics of the rod-like members in FIGS. 11 and 12, in coaction with the solid body of the corner joint 430 in FIG. 11 lie in (a) utilizing screw means as one of the alternate means of fixing the ends of two of the rods, e.g., inter-engagement of threaded portions 432 which are manipulated by means of slats in the protruding heads 434 of these fixed red ends; (b) utilizing a unique latching member 436 constructed as a longated body with a head and threads 439, a slot 438 provided in the head portion, which is formed between the sides of the head, and bevelled finger grip portions 440 at each side of the slot, these portions permitting easy finger manipulation for disassembly. The bevelled edges aid insertion and the cross section functions as a spring clip yielding to the side sleeves pressure during insertion and expanding in the locked position with the offset portion below the inner lower edge of the bevel serving as the inner retaining surface.

In FIGS. 18, 19 and 20 are shown totally enclosed apex joints 470, 480 and 500. These joints each comprise rod-like members which are enclosed within the body of the apex joint. Thus, in apex joint 470, the rod-like body 472 comprises either a solid rod or a telescoping tube. These ends of the rod-like body are fastened securely within the sleeves of the body portion of the apex joint 470 by means of a screw means 474. The encased ends of the rod are bent inwardly to be in line and are adapted for encirclement within the respective sleeve portions of the joint while the remote ends are at the proper angle. Obviously, the screw means 474 serves a principal function as retainer for the inwardly bend end of the rod 472 and this screw means 474 may be replaced by a cap, adhesively fastened, or a tapped fastening means serving the same function.

It is useful to compare structure and function of the totally enclosed apex joints 470, 480 and 500 of FIGS. 18, 19 and 20 with the open sleeve type joints of FIGS. 13, 14 and 15. The illustrated totally enclosed embodiments have body portions of six sides (FIG. 19), 5 sides (FIG 18) and four sides (FIG. 20). The progression may go to three sides (FIG. 4, FIG. 10 and FIG. 11). In short, a common feature which assists in assembling operation for the unsighted, is to touch and recognize the 3, 4, 5 or 6 sides. Obviously, more than 6 sides can be formed to enclose the corresponding number of rod ends in pockets thereof and also this concept applies to corner joints and apex joints. For each enclosed type and number of sleeve joints in the solid body type of joint, there is a corresponding open body type; e.g., compare FIG. 13 and FIG. 3, FIG. 14 and FIG. 3, FIG. 15 and FIG. 20, FIG. 16 and FIG. 11 and so forth.

The benefits and advantages of the invention will be more fully understood in the sections following which describe 1. building of geometric structures
2. construction of utilitarian articles, such as tents, fluorescent reflector, flare housing, or flare support and the like
3. toys, especially kites and gliders and games which require a backstop or a fixed goal such as soccer, water polo, kickball, hockey or ground level basketball.

GEOMETRIC STRUCTURES

Collapsible structures can be achieved in a unique manner, with a single apex joint, the three arm apex of FIGS. 1 or 2 provides the collapsible bundle shown in FIG. 5 and a four sided tetrahrfton results.

The four arm single apex joint of FIG. 6 provides in collapsed condition a similar collapsed bundel as in FIG. 5 and a five sided polyhedron in the assembled position.

The five arm single apex joint of FIGS. 17 or 18 provides a similar collapsed fundle and a six sided polyhedron in the assembled position.

Obviously, one may increase the number of arms which are retained by the apex in polyhedra which are adapted to be similarly collapsed.

Combinations of polyhedra may be assembled. For example, of two polyhedra as in FIG. 7 are placed base to base, a solid cube or parallelopiped, above, one can have a housed shape, e.g., a peaked roof over a box. These shapes are especially useful for tent frames or for green house frames, wherein the covering roof structure consists of a suitable flexible film such as plastic or the like. Obviously, the roof structure is not limited to a two sided or peaked roof, it may have any number of sides to simulate a tower.

TENTS, REFLECTORS AND THE LIKE

By apinting the rod-like elements with fluorescent paint or covering with a fluorescent tape or woven textile sleeve or the like, a reflective flare-light sign or stand can be readily created from the various geometric constructions.

As mentioned above, the embodiment in FIG. 7 is of outstanding value as a tent frame.

Also the pyramids of FIGS. 1 or 2 may be used as a lantern support to hang the lantern from a hook in the apex which can rest on any flat surface.

GAMES AND TOYS

The embodiments of FIGS. 1 and 2 are easily usable as kite frames for various types of fabric coverings.

The open sides adapt the pyramids of FIGS. 1 and 2 as a goal for water polo, (floating wooden or plastic rod-like elements) or for ground level basketball.

The goal would, of course, be fitted with inner net and could also be used in the frame embodiment of FIG. 7.

What is claimed is:

1. A collapsible enclosure frame including a rod and sleeve joint structure for construction of tent enclosures and the like comprising:

a. a plurality of rods each having a short arm portion serving as part of the joint structure and a long rod portion serving as straight frame elements of the enclosure; said long rod portion and said arm portion being angularly off set from one another; and b. at least one sleeve portion forming a corner of the enclosure said sleeve portion including at least three parallel longitudinal pockets having parallel axes, each pocket receiving one of said arm portions for axial pivotal movement about said arm such that said rod portions may be rotated about said arm portions from a parallel relationship comprising the collapsed condition of the frame to a mutually diverging relationship comprising the erected condition of said enclosure frame.

2. A collapsible rod and sleeve joint structure as claimed in claim 1 wherein said polyhedron is a regular pyramid.

3. A structure as claimed in claim 1 wherein said polyhedron is a tetrahedron.

4. A structure as claimed in claim 1 wherein there are provided two apex joints at the top of said polyhedron and wherein the base of said polyhedron forms a rectangular base from said structural frame elements.

5. A structure as claimed in claim 4 wherein two of said structural frame elements at sides of the rectangular base are formed of telescoping tubes.

6. A collapsible rod and sleeve joint structure forming a polyhedron comprising:

a plurality of rod elements formed of telescoping tubes each serving as the straight frame element of the polyhedron;

arms at the ends of said frame elements;

a plurality of sleeves, each forming a corner of the polyhedron and each adapted to fold within the sleeve the arm mounting the associate straight frame elements of at least three frame elements to thereby form a common corner for said three frame elements;

at least one of said common sleeve corners of said frame elements constituting an apex joint in which said at least three frame elements are fixed along a substantial length of each arm but can be rotated axially within the sleeve to move the frame element associated with the fixed arm from a collapsed position with the arms parallel to an open position with the frame elements diverging from said apex to form edges of the polyhedron;

the others of said common sleeve corners having inner sleeves means to permit insertion and withdrawal of an arm and its associated frame element whereby insertion of the arm into the sleeves will lock the frame in an open position of the polyhedron and withdrawal of the arm from the sleeve will collapse the polyhedron by allowing the frame element to be folded in parallel relation either above or below the folded frame elements joined to said apex joint; and said others of said common sleeve corners having a body in the form of a C-shaped clip with a two sided channel for three rods adapted to retain the ends of two of said rods while an end of a third rod is insertable and detachable, said clip providing a spring action and to aid insertion of said third end by expansion of the clip.

7. A structure as claimed in claim 6 where in said two retained ends, of said other common sleeve corners have a non removable retaining means engaging the base of said C-shaped clip.

* * * * *